US011167342B2

(12) United States Patent
Platzer

(10) Patent No.: US 11,167,342 B2
(45) Date of Patent: Nov. 9, 2021

(54) MODULE FOR A DIE-CASTING DEVICE

(71) Applicant: THIXOTROPIC PISTON INJECTION TECHNOLOGY GMBH, Gleisdorf (AT)

(72) Inventor: Christian Platzer, Graz (AT)

(73) Assignee: THIXOTROPIC PISTON INJECTION TECHNOLOGY GMBH, Gleisdorf (AT)

( * ) Notice: Subject to any disclaimer, the term of this patent is extended or adjusted under 35 U.S.C. 154(b) by 0 days.

(21) Appl. No.: 17/051,647

(22) PCT Filed: Mar. 6, 2019

(86) PCT No.: PCT/AT2019/060072
§ 371 (c)(1),
(2) Date: Oct. 29, 2020

(87) PCT Pub. No.: WO2019/213678
PCT Pub. Date: Nov. 14, 2019

(65) Prior Publication Data

US 2021/0220908 A1 Jul. 22, 2021

(30) Foreign Application Priority Data

May 11, 2018 (AT) ..... A 50394/2018

(51) Int. Cl.
*B22D 17/20* (2006.01)
*B22D 17/00* (2006.01)

(52) U.S. Cl.
CPC ..... *B22D 17/2061* (2013.01); *B22D 17/007* (2013.01)

(58) Field of Classification Search
CPC .. B22D 17/2061; B22D 17/007; B22D 17/00; B22D 17/2015; B22D 17/2023; B22D 17/203
See application file for complete search history.

(56) References Cited

U.S. PATENT DOCUMENTS

2016/0221074 A1 8/2016 Bültermann

FOREIGN PATENT DOCUMENTS

| | | |
|---|---|---|
| DE | 41 21 961 | 1/1993 |
| DE | 601 08 790 | 3/2006 |
| JP | 3138653 | 2/2001 |
| JP | 2004243337 | 9/2004 |

(Continued)

OTHER PUBLICATIONS

Austria Search Report conducted in counterpart Austria Appln. No. A 50394/2018 (dated Dec. 18, 2018).

(Continued)

*Primary Examiner* — Kevin P Kerns
*Assistant Examiner* — Steven S Ha
(74) *Attorney, Agent, or Firm* — Greenblum & Bernstein, P.L.C.

(57) ABSTRACT

A module for a die-casting device that includes a base that can be fastened to a mounting plate of the die-casting device, a screw/cylinder unit for producing a thixotropic material, and a filling chamber, wherein the screw/cylinder unit and the filling chamber are arranged indirectly or directly on the base such that thixotropic material produced by the screw/cylinder unit can be conveyed into the filling chamber.

12 Claims, 10 Drawing Sheets

(56) References Cited

FOREIGN PATENT DOCUMENTS

| | | | |
|---|---|---|---|
| WO | 2013/067567 | 5/2013 | |
| WO | WO-2015084260 A1 * | 6/2015 | ..... B22D 17/2023 |

OTHER PUBLICATIONS

Int'l Search Report conducted in Int'l Appln. No. PCT/AT2019/060072 (dated Apr. 26, 2019).
Int'l Written Opinion conducted in Int'l Appln. No. PCT/AT2019/060072 (dated Apr. 26, 2019).

* cited by examiner

MODULE FOR A DIE-CASTING DEVICE

BACKGROUND

(1) Field of the Invention

The invention relates to a module for a die-casting device.

(2) Description of the Background

The invention furthermore relates to a method for producing a molded part using a die-casting device.

Die-casting devices such as those known from the prior art allow molded parts to be created from a light metal or a light metal alloy, for example an aluminum alloy or magnesium alloy, with high precision and in large quantities within a short time. Due to the quantitatively high yield of molded parts using die-casting devices, these devices are widely used.

The production of similar or identical molded parts in a thixomolding process is also known. Similar to a die-casting, a material is thereby introduced into a filling chamber and injected or pressed into the mold cavity from this filling chamber via a nozzle by means of a screw that functions as a plunger in this process step. In contrast to die-casting, in which a pure melt of a metal or an alloy is used, thixomolding works in the semi-solid zone between the solidus curve and liquidus curve. There are two phases in this zone, namely the melt on the one hand and solid particles on the other hand. Through an additional application of shearing forces, a thixotropic state is achieved so that thixotropic material can be injected. It has been shown that a material basis of this type results in molded parts with improved properties.

Even though a thixomolding process can lead to improved molded parts, it has not yet been possible for this technology to supplant the widely used die-casting to date. Thixomolding devices with short cycle times of a few seconds require considerable process expertise, especially since the injected material is present in a thixotropic state and must for this purpose first be processed and subsequently also injected. The relatively complex process technology can result in a significant amount of scrap, but also in machine downtime. The complexity of this technology is also apparent from the fact that only a small number of companies worldwide produce thixomolding devices. Although fundamentally improved molded parts can be produced using a thixomolding process, this technology has not yet become prevalent for these reasons.

SUMMARY

This is addressed by the invention. The object of the invention is to specify a module for a die-casting device, with which module the die-casing device can easily be converted such that a thixomolding process can be run using the die-casting device.

A further object is to specify a method for producing a molded part using a die-casting device.

The object is attained according to the invention with a module for a die-casting device, comprising a base which can be fastened to a mounting plate of the die-casting device, a screw/cylinder unit for producing a thixotropic material, and a filling chamber, wherein the screw/cylinder unit and the filling chamber are arranged indirectly or directly on the base such that thixotropic material produced by the screw/cylinder unit can be conveyed into the filling chamber.

One advantage achieved with the invention is that a module is provided which can easily be integrated into existing die-casting devices. In this manner, it is possible to convert a die-casting device from the typical die-casting process to a thixomolding process within a short amount of time. The plurality of die-casting devices already in use can thus be used to produce molded parts by means of thixomolding. The invention is thereby also beneficial in that the module can be fastened to a mounting plate of the die-casting device, or is fastened there during use. The die-casting device thus does not require any larger conversion work per se; rather, it is possible to merely fasten the module according to the invention to the front of a mounting plate on the die-casting device that is closer to the plunger necessary for injection. The module can thus be arranged between the mounting plates and therefore in the actual tooling enclosure. The two die halves of the casting tool for forming a mold cavity can then be arranged in typical fashion on the opposing mounting plate and the base of the module. Thus, by arranging the module between the mounting plates, a kind of double layer is created. This concept allows the conversion expenditure to be minimized.

The screw/cylinder unit comprises a cylinder and a screw. The screw is arranged in the interior of the cylinder. The screw is used to place fed material, normally a metal or an alloy, in a thixotropic state, which is to be used for injection into the mold cavity after the closing of the die halves. To reach the necessary temperatures within the screw/cylinder unit, a temperature-control unit is provided. The temperature-control unit is normally embodied as a heating element. The heating element can be arranged externally on the screw/cylinder unit. This element can be a resistance heating element, for example, which is arranged in regions of, or over the entire extension of, the perimeter of the screw/cylinder unit.

The filling chamber must normally also be temperature-controlled. For this purpose, the temperature-control unit of the screw/cylinder unit can also extend to an outer side of the filling chamber. Alternatively, an additional temperature-control unit can be provided for the filling chamber, which additional unit can be controlled separately from the temperature-control unit for the screw/cylinder unit. The temperature-control unit for the filling chamber can also be a resistance heating unit. The one or more temperature-control units are designed such that, in the screw/cylinder unit and the filling chamber, the necessary temperatures for processing light metals or light metal alloys are reached, for example in the temperature range of 400° C. to 700° C.

For an injection operation, it is necessary that thixotropic material is produced and introduced into the filling chamber by the screw/cylinder unit. A screw of the screw/cylinder unit is rotatably mounted for these purposes. A motor is provided for the rotation of the screw. In addition, the screw is axially displaceable. Because the screw is arranged such that it can be axially displaced in the cylinder, thixotropic material that has been created can be pressed forward into the filling chamber by the screw being axially displaced in the direction of the filling chamber. It has been shown that, as a result of the corresponding axial displacement, an excellent feed control for the filling chamber is possible. However, it is also possible that the screw is only ever rotated and that the filling chamber is filled via the feed pressure that is generated. The screw then only needs to be moved a few millimeters, namely to close off the passage to the filling chamber or clear it for filling.

After a predetermined amount of thixotropic material has been introduced into the filling chamber, it is necessary for the injection operation to prevent a backwards flow of the thixotropic material from the filling chamber back into the screw/cylinder unit. For this purpose, the filling chamber comprises a sealing seat against which a first end of the screw can be positioned. The sealing seat can, in particular when viewed from the direction of the screw, be embodied to be conically tapered. If the screw is positioned against the sealing seat by axial displacement, a backflow of material into the screw/cylinder unit is avoided. Of course, a first end of the screw is for this purpose embodied with a contact surface at the end, which contact surface corresponds to the sealing seat of the filling chamber, so that the desired sealing function is achieved.

The screw/cylinder unit can be arranged in any desired manner in relation to the base and therefore ultimately also in relation to the die-casting device. Advantageously, the screw/cylinder unit is arranged vertically. However, it is also possible to mount the screw/cylinder unit horizontally, and to fill the filling chamber from a side.

The filling chamber is typically arranged horizontally so that a, normally horizontally arranged, plunger of a die-casting device that is being converted can be guided into the chamber without additional modification measures.

Subject to limitations of the acting forces, the base can be structured to be relatively thin. An approximately plate-shaped structure is preferred, since the module can then be fastened to the mounting plate in a planar manner. To provide adequate space for accommodating the screw/cylinder unit, the base can comprise a central open space into which the screw/cylinder unit projects. This open space extends at least to the filling chamber so that the screw/cylinder unit can be coupled to the filling chamber.

For the necessary axial displaceability of the screw of the screw/cylinder unit, a first lifting device can be provided with which the screw of the screw/cylinder unit can be axially displaced. This can be a hydraulic or pneumatic lifting device. The first lifting device can be mounted on the base or on a component connected thereto in a stationary manner, so that the relative displaceability of the screw with regard to the cylinder of the screw/cylinder unit is rendered possible.

The screw/cylinder unit can be connected to the base in various ways. In one version, the screw/cylinder unit can be mounted on a plate at the top end, which plate is fastened to the base. A first lifting device can then be mounted on the plate so that the screw of the screw/cylinder unit can be displaced relative to the plate, and therefore to the base and subsequently also to the filling chamber that is mounted on the base.

It is also possible that the screw/cylinder unit is mounted on the filling chamber. For example, the screw/cylinder unit can be mounted on an outer part of the filling chamber, wherein the outer part is connected to the base. This version has the advantage than an inner part of the filling chamber can be connected to the outer part of the filling chamber such that the inner part can be detached by displacement. If a second lifting device is additionally provided, with which device the screw/cylinder unit can be axially displaced relative to the outer part of the filling chamber, the inner part of the filling chamber can be removed with a corresponding axial displacement of the screw/cylinder unit. This is important insofar as this inner part is subjected to the greatest wear because of the high pressure prevalent during injection and because of the thixotropic material used. With a corresponding lifting movement, and therefore an uncoupling of the screw/cylinder unit from the filling chamber, the inner part of the filling chamber is exposed and can, from the front side, be removed and replaced by an inner part that is in a new condition. In accordance with the preceding statements, a die-casting device can be equipped with a module according to the invention.

The further object of the invention is attained with a method for producing a molded part using a die-casting device with a module according to the invention.

One method-related advantage obtained can be seen in that molded parts can be produced in a thixomolding process using a conventional die-casting machine which has been retrofitted with a module according to the invention. High-quality molded parts can thus be created in large quantities. In contrast to the prior art, it can thereby also be provided that a plug does not form between the screw/cylinder unit and the filling chamber during injection, as has thus far been typical in some cases in thixomolding processes. Instead, with a temperature control, the entire transition region between the screw/cylinder unit on one side and the filling chamber on the other side is kept at a temperature at which plug formation does not occur. This has proven advantageous in terms of a precise feed of thixotropic material to the filling chamber. Between the filling chamber and mold cavity, a plug can form in the typical manner at the end of the nozzle during or at the conclusion of the injection operation.

BRIEF DESCRIPTION OF THE DRAWINGS

Additional features, advantages and effects of the invention follow from the exemplary embodiments described below. In the drawings which are thereby referenced.

DETAILED DESCRIPTION

Figure 1:
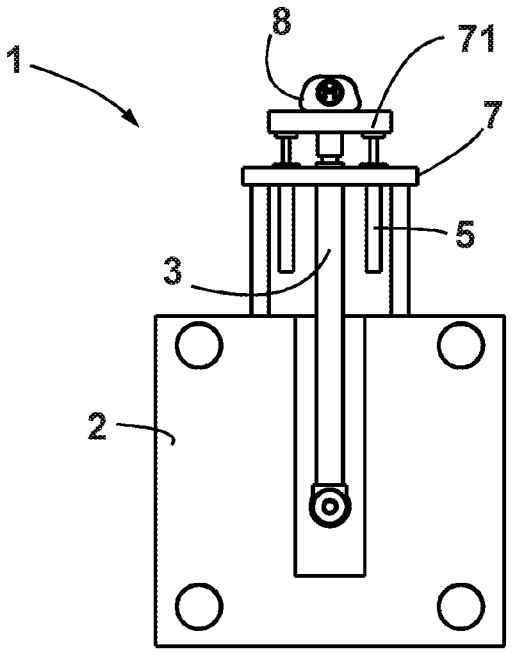
FIG. 1 shows a first version of module.
Figure 2:
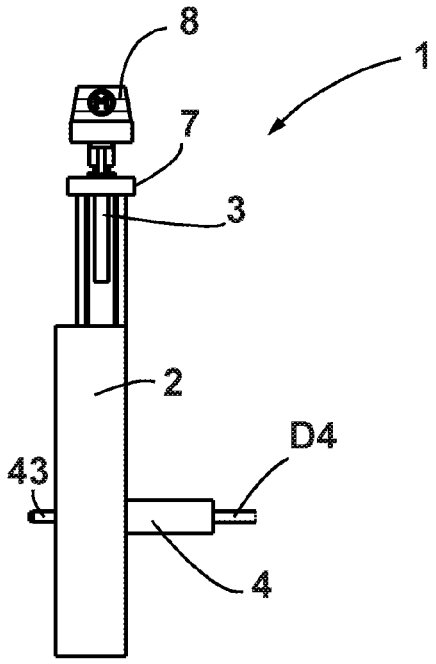
FIG. 2 shows a side view of the module according to FIG. 1.
Figure 3:
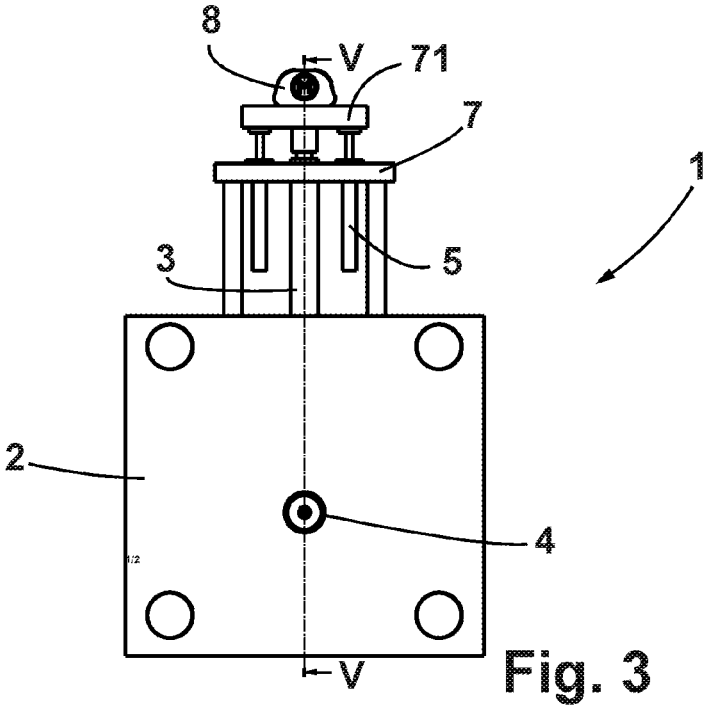
FIG. 3 shows a back side of the module according to FIG. 1.

In FIGS. 1 through 6, a first version of a module 1 is shown which can be used to convert a conventional die-casting device D1 (FIG. 7) such that thixotropic material can be injected with this device into one or more mold cavities in order to create corresponding molded parts. However, the module 1 can of course also already be integrated in or delivered with a new die-casting device D1.

The module 1 comprises a base 2. The base 2 can be embodied to be rectangular or, as illustrated, roughly square. Other basic shapes of the base 2 are of course also possible. For the sake of efficiency, however, the base 2 is embodied to be as small as possible, especially since the base 2 primarily serves to provide a substructure for a screw/ cylinder unit 3 and a filling chamber 4 and to enable the coupling thereof to a mounting plate D2 of a die-casting device D1.

In addition, the base 2 accommodates a casting mold, for which reason the base 2 is roughly the size of the mounting plate D2 wherever possible. As can be seen from FIG. 4, the base 2 is roughly embodied to have a constant thickness and comprises a central open space 22. In addition, openings 23 are provided which are used to guide suitable fasteners through so that the base 2 can be fastened to a mounting plate D2 of the die-casting device D1 using suitable fasteners.

Figure 4:
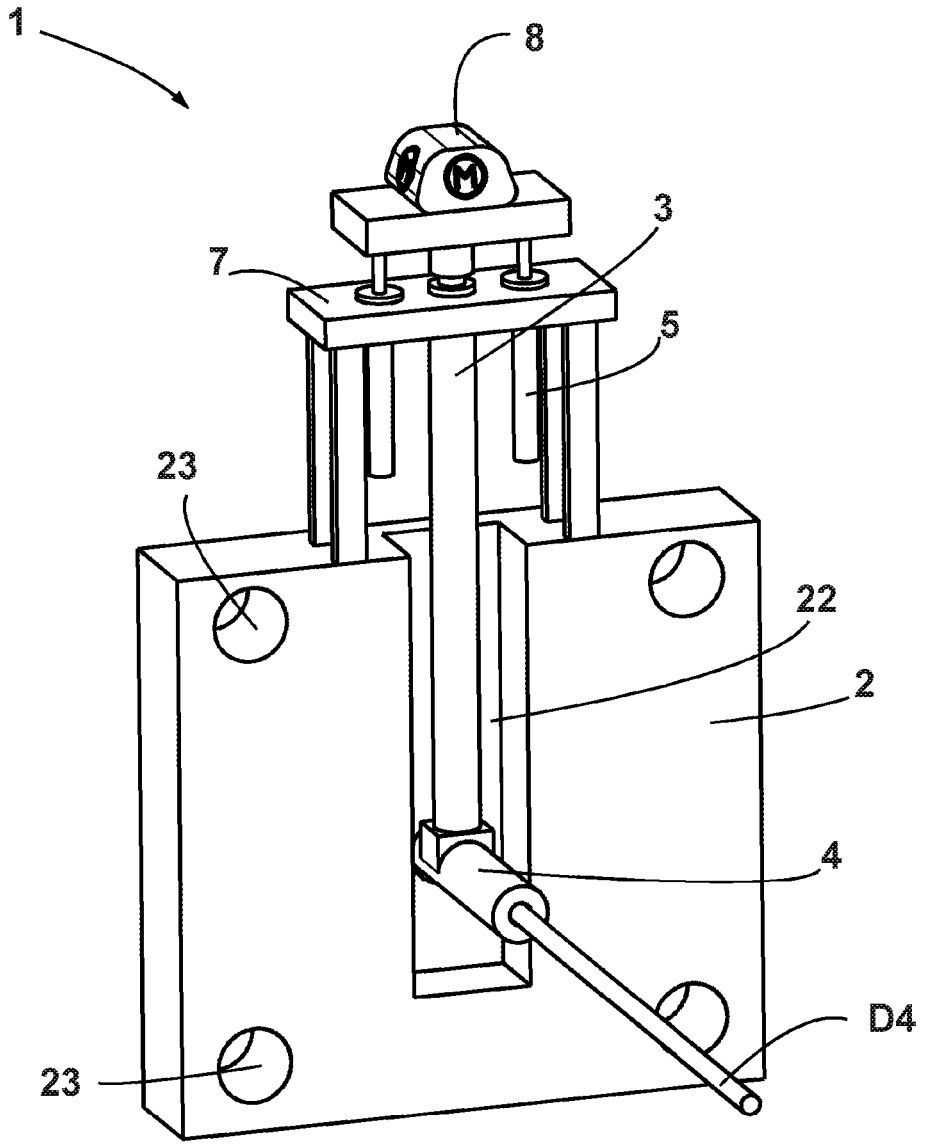
FIG. 4 shows a perspective illustration of the module according to FIG. 1.

As can be seen from FIGS. 1 and 4, the base 2, which in principle is embodied with an essentially uniform thickness, comprises a preferably central open space 22 or slot. The screw/cylinder unit 3, which projects downward in a vertical direction, runs in this slot. If injection is performed from a side, the situation illustrated in FIG. 1 would be rotated 90° to the left or right. However, a vertical arrangement is also preferred for a constant material feed from the screw/cylinder unit 3 into the filling chamber 4. After the module 1 is fastened to a mounting plate D2, a plunger D4 of a die-casting device D1 can protrude into the filling chamber 4.

The screw/cylinder unit 3 is mounted on a plate 7 at the top end, which in turn is connected to the base 2. Additionally, a motor 8 is indirectly mounted on the plate 7, namely via an intermediate plate 71 that is axially displaceable.

Figure 5:
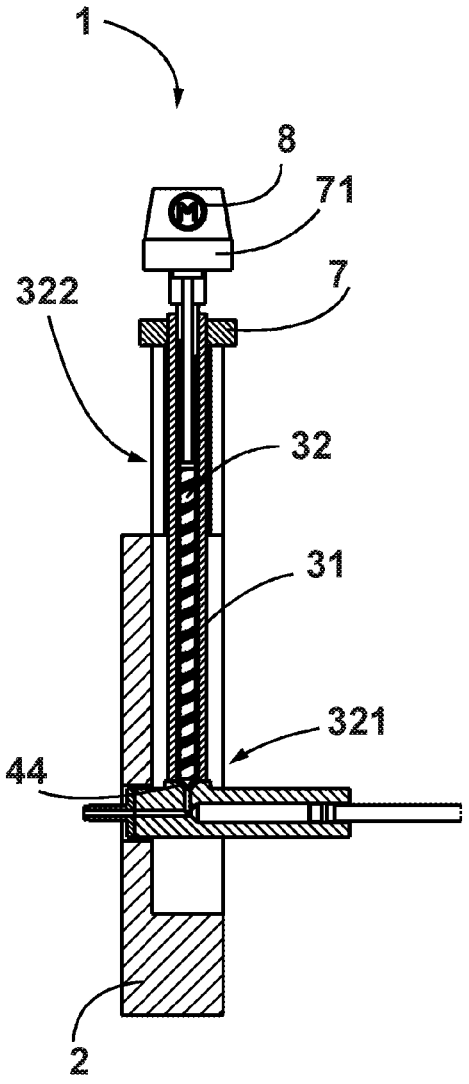
FIG. 5 shows a section of the module along the line V-V in FIG. 3.
Figure 6:
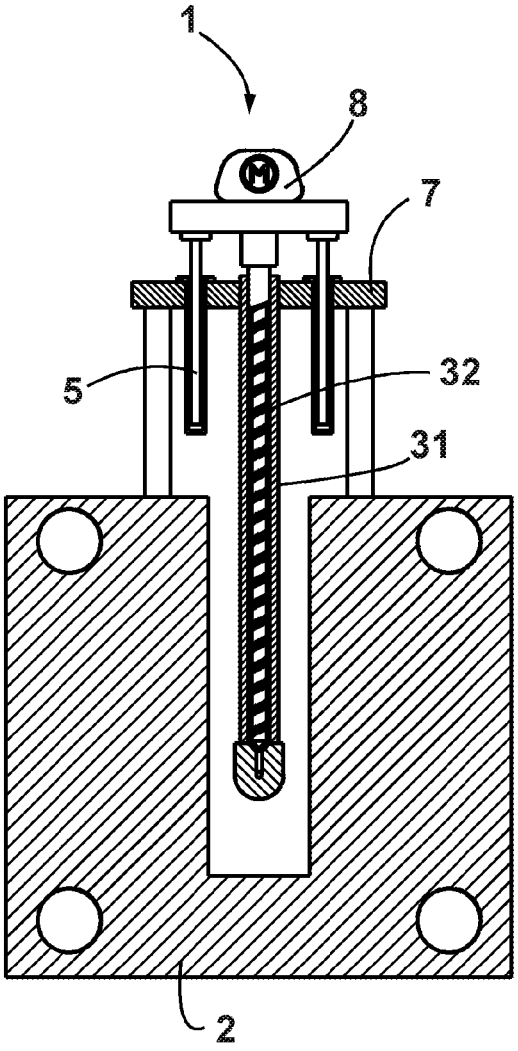
FIG. 6 shows a further section through the module according to FIG. 1.

As can be seen in the cross sections in FIGS. 5 and 6, the screw/cylinder unit 3 comprises an outer cylinder 31 in which a screw 32 is arranged. The screw 32 can be set in rotation by the motor 8. In addition, the screw 32 can be axially displaced in the cylinder 31 by the first lifting device 5 provided, wherein the intermediate plate 71 together with the motor 8 mounted thereon can be displaced in tandem in a corresponding axial displacement.

The filling chamber 4 is mounted on the base 2 and detachably connected to the vertically arranged screw/cylinder unit 3. The filling chamber 4 extends, as can be seen in particular from FIG. 2, past the base and comprises a nozzle 43 at the end, which nozzle 43 opens into a die half during an injection operation. The filling chamber 4 extends from the nozzle 43 to an opposite end of the filling chamber 4, which end serves to accommodate a plunger D4 that is part of a conventional die-casting device D1.

With the aid of FIGS. 5 and 6, the interaction of the screw/cylinder unit 3 with the filling chamber 4 can be further explained. As can be seen in the cross sections, the screw 32 runs inside the cylinder 31 of the screw/cylinder unit 3. At the first end 321, the screw 32 is embodied to be conically tapered, whereas at the opposite end 322 of the screw a roughly horizontal termination can be provided. To accommodate the first end 321 of the screw 32, the filling chamber 4 comprises a corresponding sealing seat 44. The sealing seat 44 is preferably also embodied, as viewed from the screw 32, to be conically tapered. In this manner, it is possible to prevent a backflow of thixotropic material from the filling chamber 4 back into the screw/cylinder unit 3 during an injection operation, which will be explained below. The screw 32 can be moved up and down inside the cylinder 31 by the first lifting device 5. With the motor 8, which is operatively connected to the screw 32, a rotational movement or rotation of the screw 32 can be generated.

Figure 7:
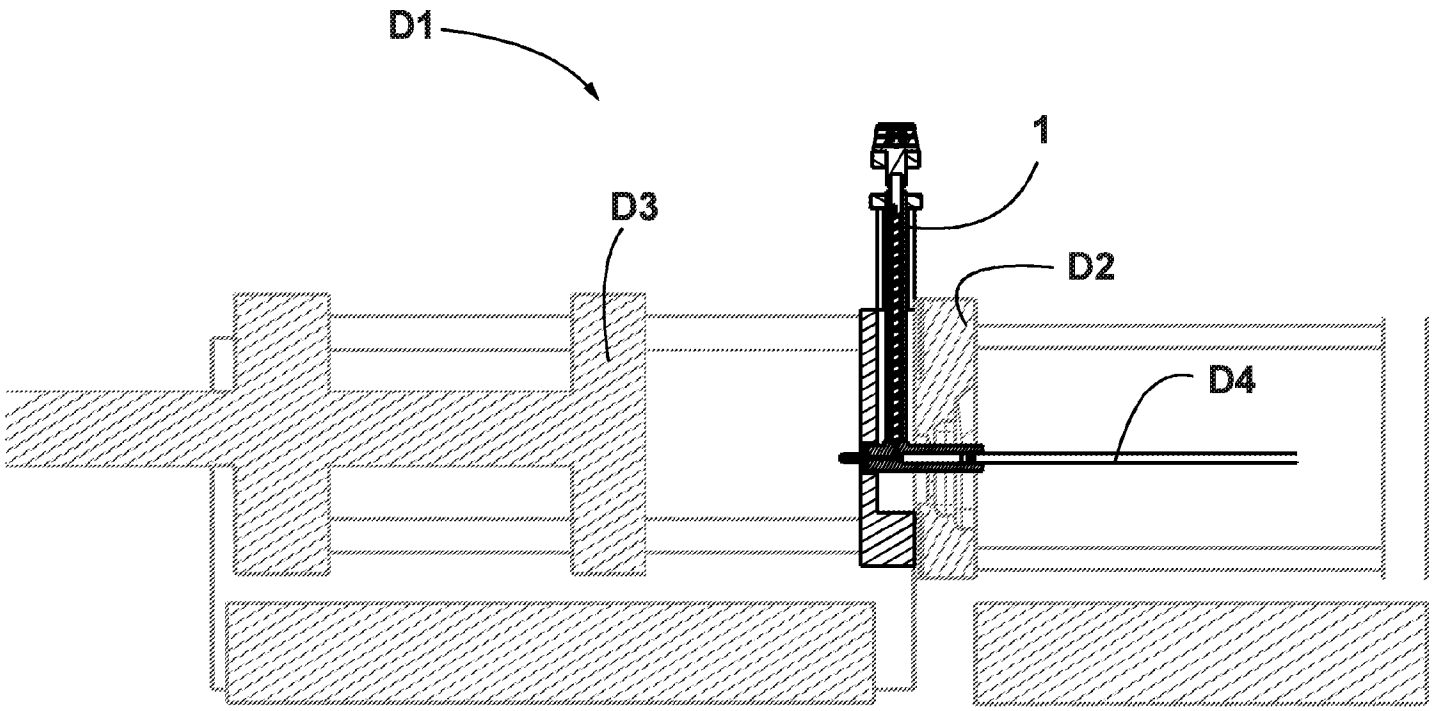
FIG. 7 shows a die-casting device with a module according to FIG. 1.

In FIG. 7, a die-casting device D1 to which a module 1 is fastened is illustrated. As can be seen, the module 1 is fastened to a first mounting plate D2 of the die-casting device D1, for which the mentioned openings 23 on the base 2 are used. As can be seen, the module 1 is fastened to the stationary mounting plate D2 and is located opposite of a moveably mounted mounting plate D3 of the die-casting device D1. Furthermore, it can be seen that the plunger D4 of the die-casting device D1 engages in the filling chamber 4 of the module 1. For the creation of a molded part, the two necessary die halves are also mounted on the mounting plates D2, D3. Thixotropic material supplied via the screw/cylinder unit 3 can then be injected into a closed mold cavity via the nozzle 43, for which purpose the movable clamping plate D3 with the die half mounted thereon is first positioned against the stationary clamping plate D2 with the die half mounted on the module 1 in that location, in order to produce the mold cavity. The injection operation can then take place. This operation is explained below.

Figure 8:
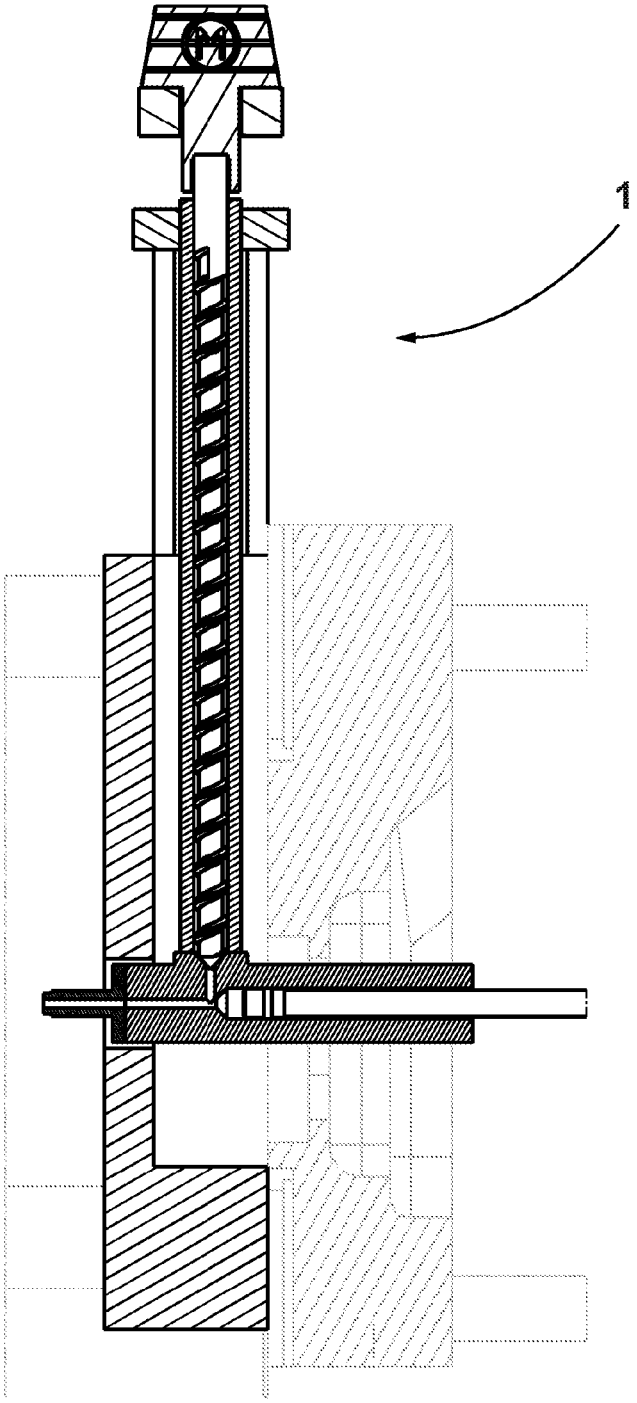
FIGS. 8 through 12 show a process sequence for an injection operation into a mold cavity.
Figure 9:
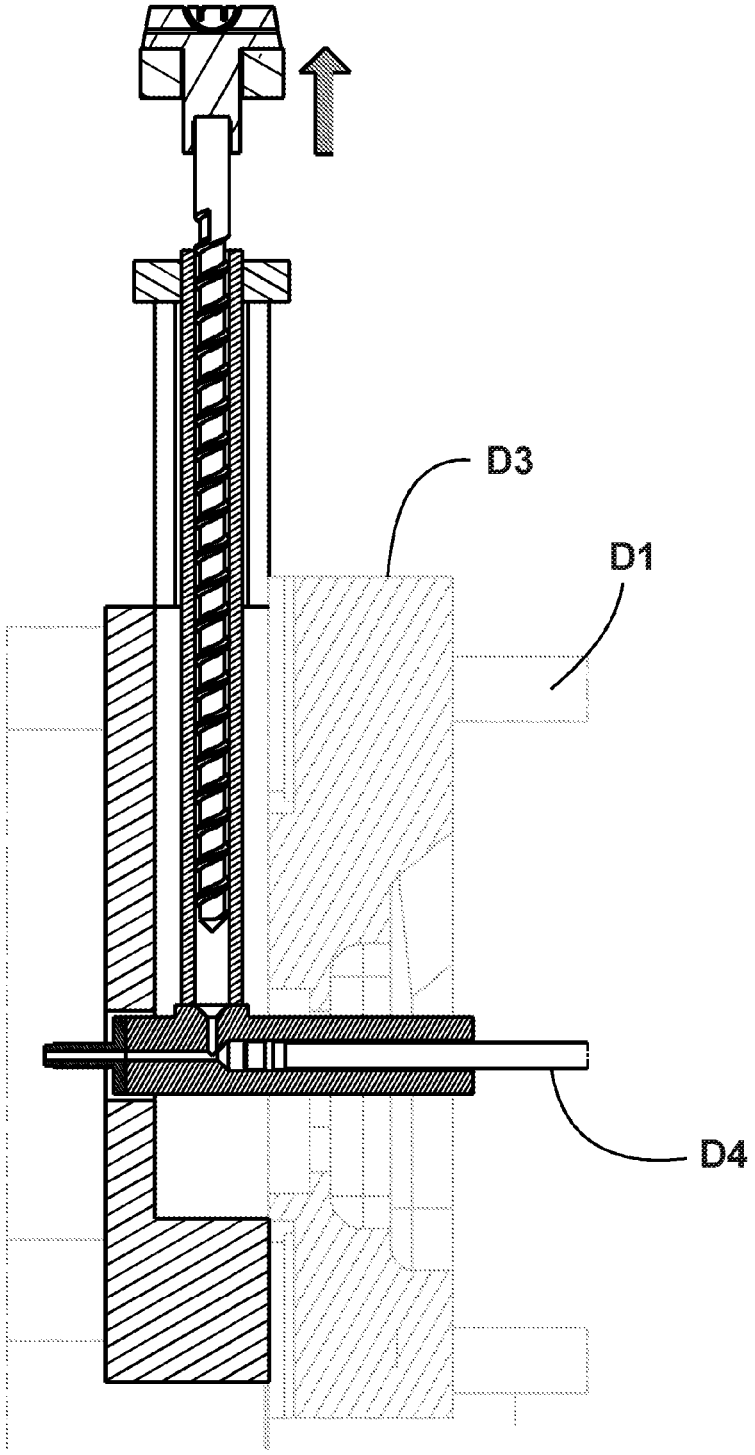
Figure 10:
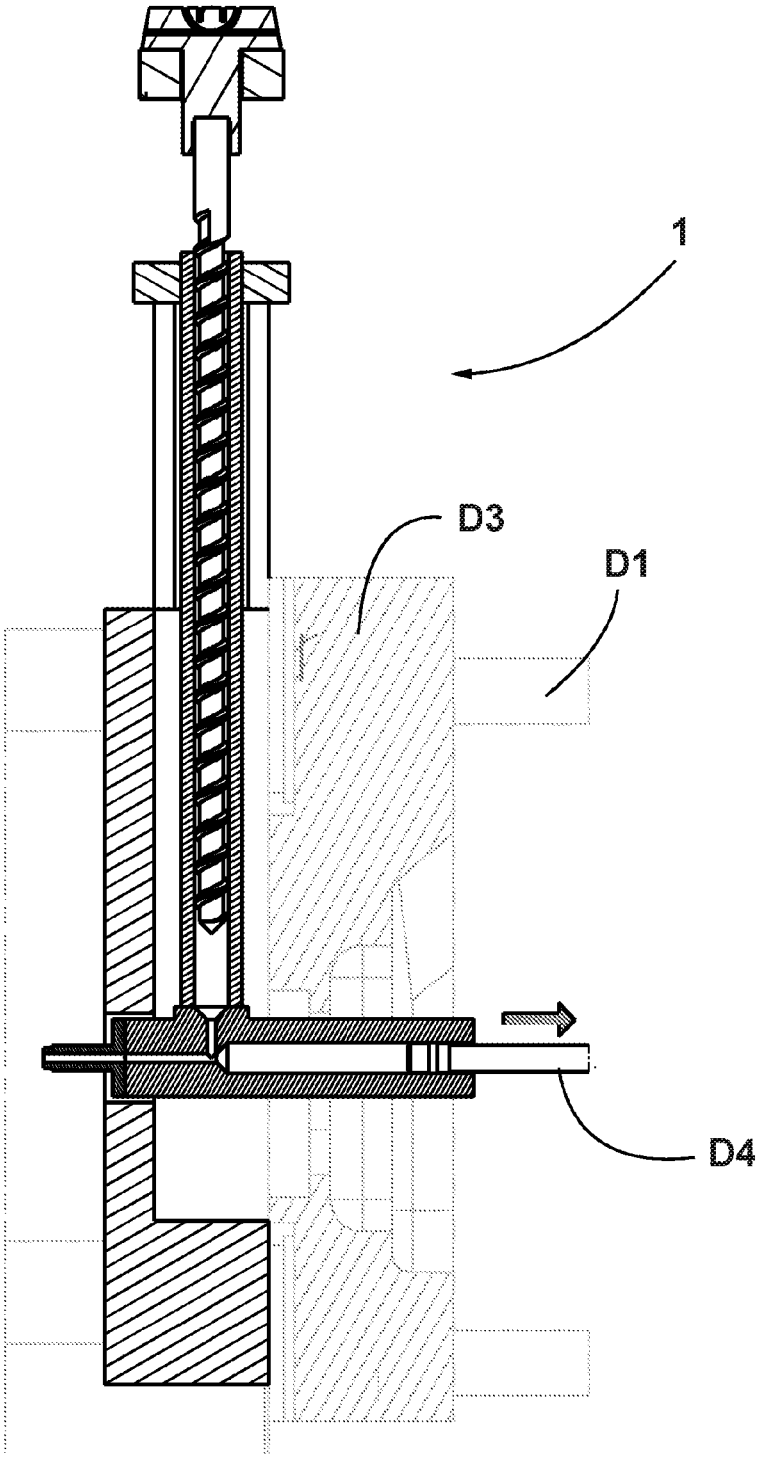
Figure 11:
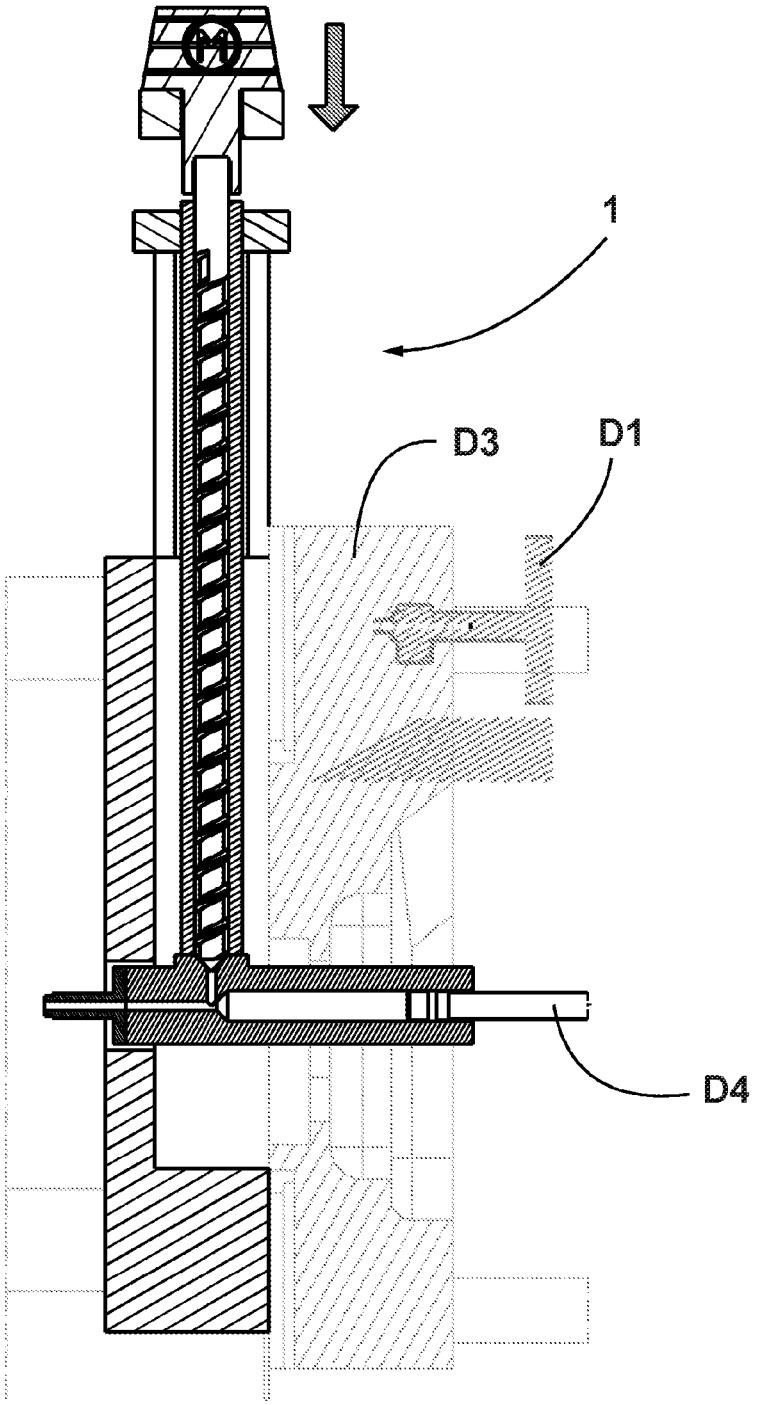
Figure 12:
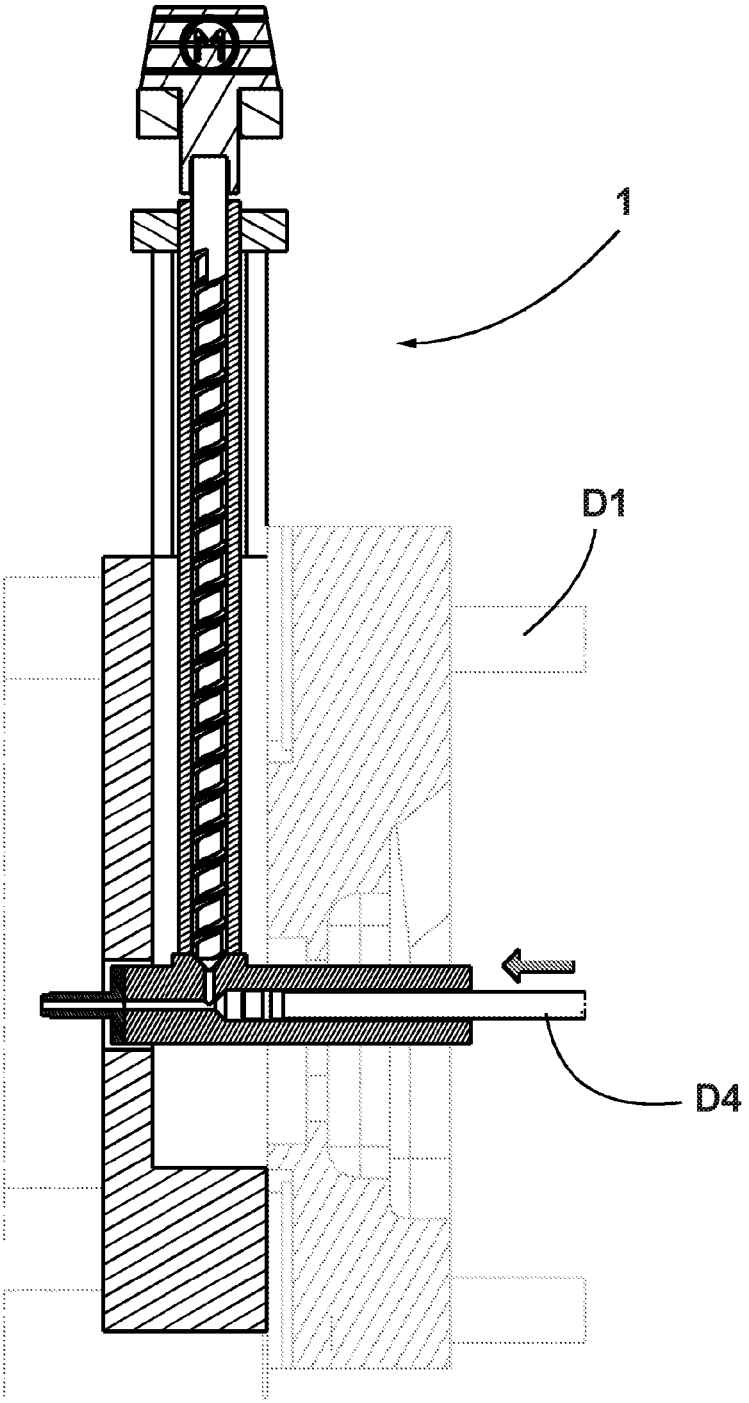

In FIGS. 8 through 12, the injection operation for the creation of a molded part from thixotropic material by means of a conventional die-casting machine D1, having been converted with a module 1, is illustrated by way of example. FIG. 8 shows an initial state in which the screw 32 is locked, which is equivalent to the state at the end of an injection operation. According to FIG. 9, the screw 32 is then unlocked and set in rotational motion by the motor 8. What is not illustrated, yet is self-evident, is that a suitable granular material or powder is fed into the screw/cylinder unit 3 to produce thixotropic material. As a result of the rotational motion of the screw 32 and a temperature set in the screw/cylinder unit 3 via heating elements which are not illustrated, the supplied granular material or powder is placed in the thixotropic state. This still occurs even during a process phase according to FIG. 10, in which the plunger D4 is retracted in order to clear exactly that space in the filling chamber 4 that is necessary for the feed of thixotropic material. Once this has been achieved, the screw 32 is displaced axially downward in the direction of the filling chamber 4 according to FIG. 11. In this manner, the thixotropic material produced is introduced into the filling chamber 4. Finally, the conically tapered first end 321 of the screw 32 moves into contact with the sealing seat 44 of the filling chamber. The screw 32 is then locked. In this manner, an excellent seal between the screw/cylinder unit 3 and filling chamber 4 is present. Then, according to FIG. 12, a forward movement of the plunger D4, and as a result the injection operation, occurs. At the end of the injection operation, the plunger D4 is once again located in the position according to FIG. 8, and the operation begins anew. Here, it should be mentioned that no plug forms between the screw/cylinder unit 3 and the filling chamber 4 during the injection operation, as is typical in thixomolding processes. Instead, the entire region is kept at one temperature so that plug formation does not occur. This has proven advantageous in terms of a precise feed control for, or filling of, the filling chamber 4, as is necessary for the creation of high-quality molded parts.

Figure 13:
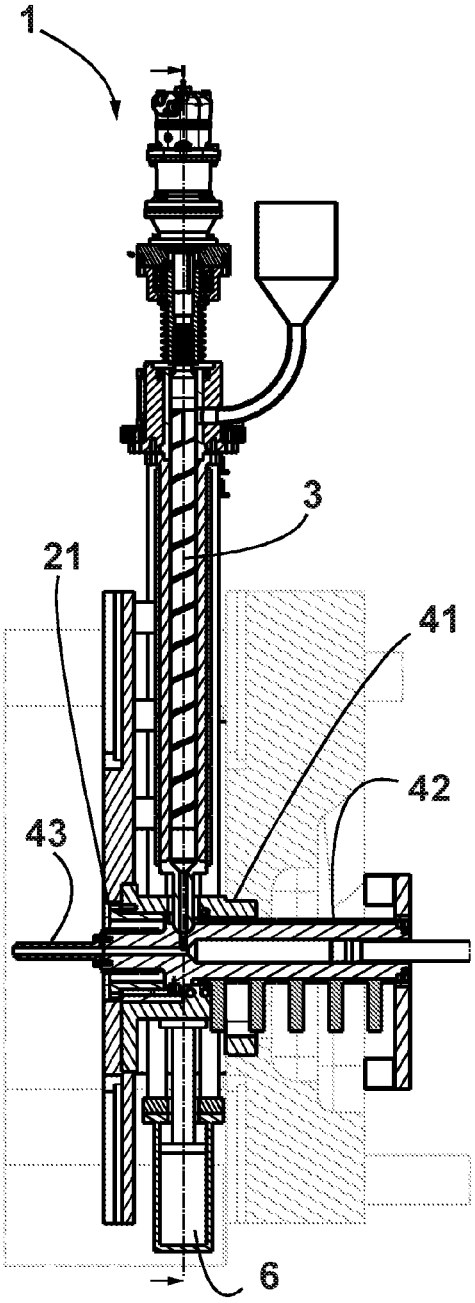
FIG. 13 shows a cross section through a second version of a module.
Figure 14:
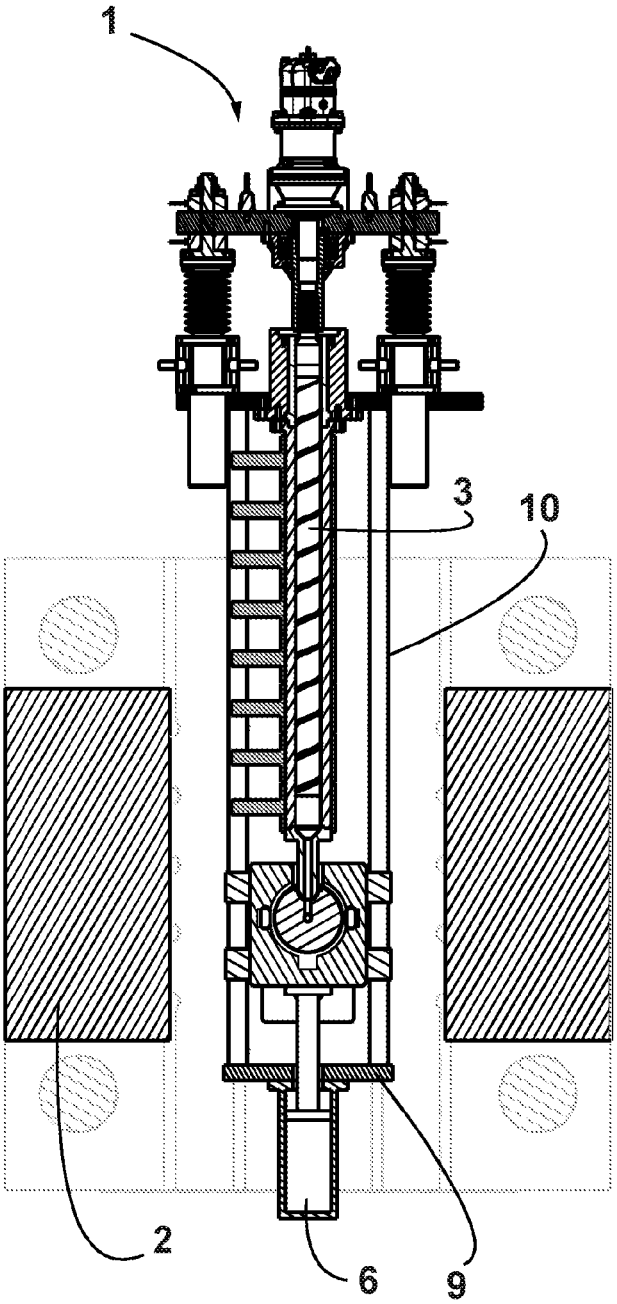
FIG. 14 shows a further cross section of the module according to FIG. 13.

In FIGS. 13 and 14, cross sections of a version of the module 1 are illustrated. This version of the module 1 is mainly distinguished by the mounting of the screw/cylinder unit 3. In contrast to the previously explained version, the screw/cylinder unit 3 is mounted on the filling chamber 4. For this purpose, the filling chamber 4 comprises an outer part 41 and an inner part 42. The outer part 41 is connected to the base 2, wherein the filling chamber 4 is, as in the first version and also all other alternative versions, guided through a base opening 21 and preferably protrudes out of this opening with the nozzle 43. At the bottom end of the outer part 41, a second lifting device 6 is provided. This can also be a hydraulically or pneumatically operated lifting device 6. Of course, as is also the case for the first lifting device 5, alternative drives are possible, such as a spindle drive. As in the first embodiment, the screw/cylinder unit 3 protrudes vertically into a central open space 22 of the base 2. With the second lifting device 6, which is fastened to the outer part 41 of the filling chamber 4, the entire screw/cylinder unit 3 can be axially displaced as such. If the second lifting device 6 is embodied as a hydraulic lifting device, the plunger is not displaced when a hydraulic medium is applied to the lifting device 6, but rather the housing and therefore a connected support 9 together with guiding means 10 that are connected to the plate 7 at the top end. A corresponding upstroke exposes an inner part 42 of the filling chamber 4. This inner part 42 is that part which is subjected to the greatest wear during operation, since the strongest forces act in the region thereof during injection. With an axial lifting of the screw/cylinder unit 3, this inner part 42 can be easily exposed, and can be removed by being pulled forward. A new wear part or inner part 42 then only needs to be inserted.

The invention claimed is:

1. A module for a die-casting device, said module comprising:

a base configured to be fastened to a mounting plate of the die-casting device;

a screw/cylinder unit for producing a thixotropic material; and a filling chamber;

wherein the base comprises a central open space into which the screw/cylinder unit projects; and wherein the screw/cylinder unit and the filling chamber are arranged indirectly or directly on the base such that thixotropic material produced by the screw/cylinder unit can be conveyed into the filling chamber.

2. The module according to claim 1, wherein:

a screw of the screw/cylinder unit is axially displaceable.

3. The module according to claim 1, wherein:

the filling chamber comprises a sealing seat against which a first end of the screw can be positioned.

4. The module according to claim 1, wherein:

the screw/cylinder unit is arranged vertically.

5. The module according to claim 1, wherein:

the filling chamber is arranged horizontally.

6. The module according to claim 1, wherein:

a first lifting device is provided with which the screw of the screw/cylinder unit can be axially displaced.

7. The module according to claim 1, wherein:

the screw/cylinder unit is mounted on a plate at the top end, which plate is fastened to the base.

8. The module according to claim 1, wherein:

the screw/cylinder unit-is mounted on the filling chamber.

9. The module according to claim 8, wherein:

the screw/cylinder unit is mounted on an outer part of the filling chamber; and the outer part is connected to the base.

10. The module according to claim 9, wherein:

an inner part of the filling chamber is connected to the outer part of the filling chamber such that the inner part can be detached by displacement.

11. The module according to claim 9, wherein:

a second lifting device is provided with which the screw/cylinder unit can be axially displaced relative to the outer part of the filling chamber.

12. A die-casting device with a module according to claim 1.

* * * * *